US006485332B1

(12) United States Patent
Kwang

(10) Patent No.: US 6,485,332 B1
(45) Date of Patent: Nov. 26, 2002

(54) SYSTEM FOR RECONFIGURING CONNECTOR COVER AND SEAL

(75) Inventor: David Kwang, Southfield, MI (US)

(73) Assignee: Yazaki North America

( * ) Notice: Subject to any disclaimer, the term of this patent is extended or adjusted under 35 U.S.C. 154(b) by 139 days.

(21) Appl. No.: 09/618,331

(22) Filed: Jul. 18, 2000

(51) Int. Cl.[7] ..... H01R 13/40
(52) U.S. Cl. ..... 439/587
(58) Field of Search ..... 439/587, 589, 439/274, 275, 680

(56) References Cited

U.S. PATENT DOCUMENTS

| | | | | |
|---|---|---|---|---|
| 4,764,129 A | * | 8/1988 | Jones et al. | 439/677 |
| 4,944,688 A | | 7/1990 | Lundergan | |
| 4,993,964 A | | 2/1991 | Trummer | |
| 5,226,832 A | | 7/1993 | Dejardin et al. | |
| 5,551,892 A | | 9/1996 | Endo et al. | |
| 5,569,051 A | | 10/1996 | Endo et al. | |
| 5,704,796 A | | 1/1998 | Swenson | |
| 5,707,251 A | * | 1/1998 | Sakai et al. | 439/589 |

FOREIGN PATENT DOCUMENTS

| | | |
|---|---|---|
| JP | 08227754 A | 9/1996 |
| JP | 09-204954 | 5/1997 |

* cited by examiner

*Primary Examiner*—Neil Abrams
*Assistant Examiner*—Javaid Nasri
(74) *Attorney, Agent, or Firm*—Young & Basile

(57) ABSTRACT

In a wire harness connector body of the type having an end cover with a plurality of terminal openings and a mating seal having a corresponding plurality of terminal openings, a delete plug for insertion into a terminal opening in the cover such that it plugs that terminal opening against the insertion of a terminated wire. The delete plug includes a seal-plugging member which is inserted into a corresponding terminal opening in the seal to maintain the sealed nature of the connector. One or more delete plugs can be added to, moved around, or removed from the cover to reconfigure a basic cover and seal arrangement to accept different numbers or placement of terminated wires.

13 Claims, 2 Drawing Sheets

SYSTEM FOR RECONFIGURING CONNECTOR COVER AND SEAL

FIELD OF THE INVENTION

The present invention is in the field of sealed electrical connectors of the type used in automotive wire harnesses.

BACKGROUND OF THE INVENTION

Multi-terminal wire harness connectors, especially those used in vehicles, are often sealed to protect the terminal connections from corrosion due to water, salt, and chemicals. The point at which the terminated wires enter the connector bodies is often provided with a seal, sometimes known as a "mat" or "cable" seal, comprising a plug of rubber or similar elastomeric sealing material having holes for the passage of terminated wires in a watertight sealing fit. One particular type of seal is secured in the connector housing by a rear cover or "holder" having an array of terminal openings which matches the seal openings in location and number.

FIGS. 1 and 2 represent a typical connector housing, seal, and rear cover combination of known type, with FIG. 1 showing a sixteen-terminal connector and FIG. 2 showing a ten-terminal connector. A female connector housing 10, typically molded from plastic, comprises a rear opening 10*a*, a rear shroud 10*b* surrounding the opening, and locking structure 10*c* formed on the sides of the shroud to receive mating locking structure from a rear cover or holder 12. A seal 14 is sized to fit snugly in rear opening 10*a* of the connector housing, preferably stopped by internal structure in the housing of such known type as internal partitions associated with connector structure in the housing, or one or more peripheral stop members 10*e* formed around the inside of shroud 10*b*.

The thickness of seal 14 is preferably such that a front portion of the seal is contained within rear shroud 10*b* in the connector, while a rear portion extends into rear cover 12 when cover 12 is locked against the rear of the connector housing. This arrangement provides a seal around the inner periphery of the junction between connector housing 10 and rear cover 12.

Rear cover 12 is provided with a number of terminal openings 12*a* adapted to receive terminated wires therethrough and, preferably, to lock a rear portion of the fully inserted terminated wire therein in known fashion. Seal 14 includes a number of terminal openings 14*b* matching in number and position the terminal openings 12*a* in rear cover 12. In FIG. 1 the seal has sixteen terminal openings and in FIG. 2 the seal has ten terminal openings, each matching the terminal openings in its respective rear cover.

It will be noted from FIGS. 1 and 2 that connector housings 10 are identical, while their seals and rear covers differ in the number of terminated wires they are capable of accepting. This is a common arrangement designed to allow a wire harness manufacturer to pick and choose among different seals and rear covers to accommodate precisely the number of terminated wires which connector 10 requires for a particular wiring harness arrangement. The connector receiving structure in housing 10 (not shown, but well known to those skilled in the art) will normally be set up to accommodate the largest number of anticipated terminal wires, in the illustrated embodiment up to sixteen. Accordingly, the FIG. 2 embodiment with only ten terminal openings in the rear cover and seal would leave six terminal connections inside housing 10 empty upon assembly.

SUMMARY THE INVENTION

To eliminate the need for multiple sets of covers and seals in applications where a single connector body can be used for wire harness arrangements having different numbers of terminated wires, the present invention is a "delete" plug adapted to simultaneously close a terminal opening in the rear cover and the corresponding wire opening in the seal. Any number of plugs can be added to a cover and seal combination to adapt the connector to the desired number of terminated wires for a particular connector application The delete plug has a head portion shaped and sized to mate with and close off a terminal opening in the rear cover, and preferably is further configured to be positively retained in the terminal opening in the rear cover. A front portion of the plug is adapted to be inserted into a wire opening in the seal with a sealing fit.

In the preferred form, the delete plug head is adapted to be inserted into a terminal opening in the rear cover from the inside surface of the cover, and to be positively retained in the terminal opening sufficiently to keep the plug from falling out and further to prevent push-through. The seal is then placed over the plugged cover, with openings in the seal mating with the forward prongs of each of the delete plugs retained in the rear cover. The plugged and sealed cover is then placed on the connector body, and the appropriate number of terminated wires is inserted into the remaining terminal openings in the newly-reconfigured cover.

The delete plugs are preferably removably retained in the rear cover, such that a particular cover can be reconfigured by adding, moving, or removing plugs.

The head of the delete plug is preferably provided with a polarization feature to match polarization notches or other structure typically found in the terminal openings in the rear cover.

These and other features and advantages of the present invention will become apparent upon further reading of the specification, in light of the accompanying drawings.

DETAILED DESCRIPTION OF THE ILLUSTRATED EMBODIMENT

Figure 1:
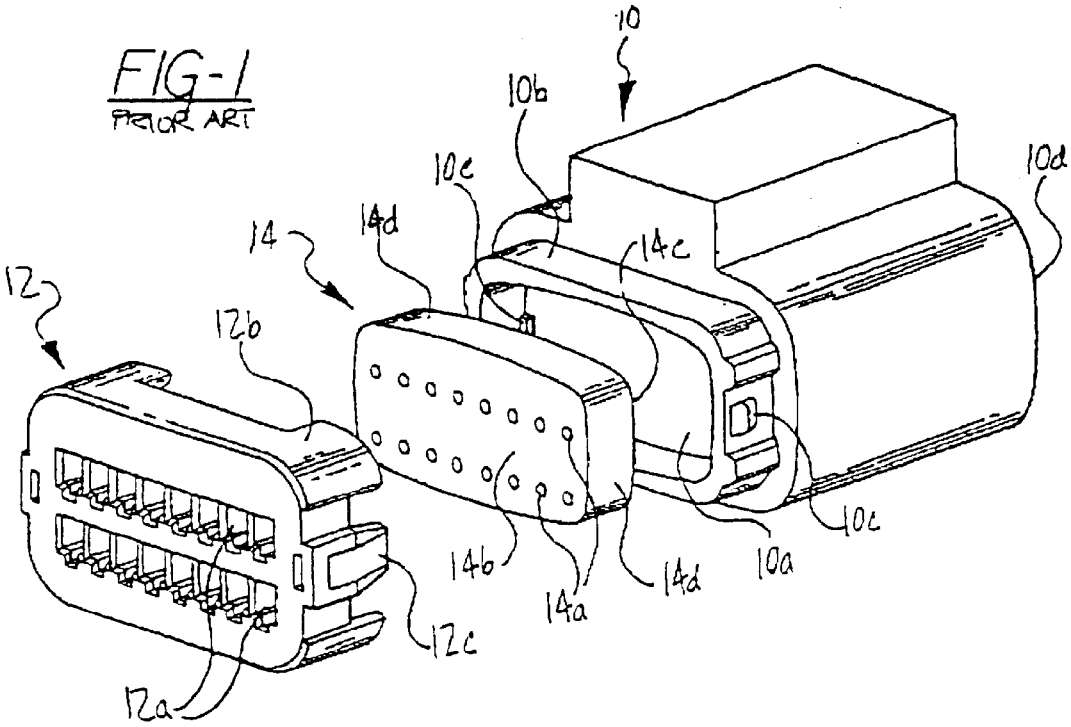
FIG-1 PRIOR ART
FIG. 1 is a perspective, exploded view of a prior art connector, seal, and cover assembly for a sixteen-terminal wire harness connection.
Figure 2:
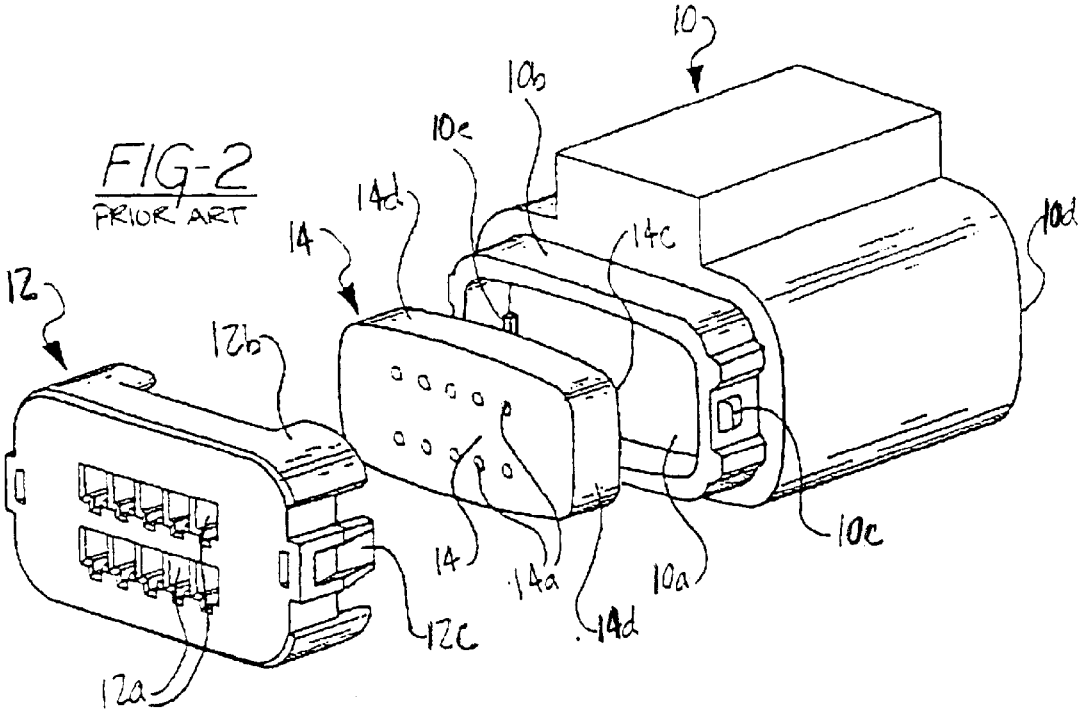
FIG-2 PRIOR ART
FIG. 2 is a perspective, exploded view of a connector, cover, and seal assembly similar to FIG. 1 but for a ten-terminal wire harness connection.
Figure 3:
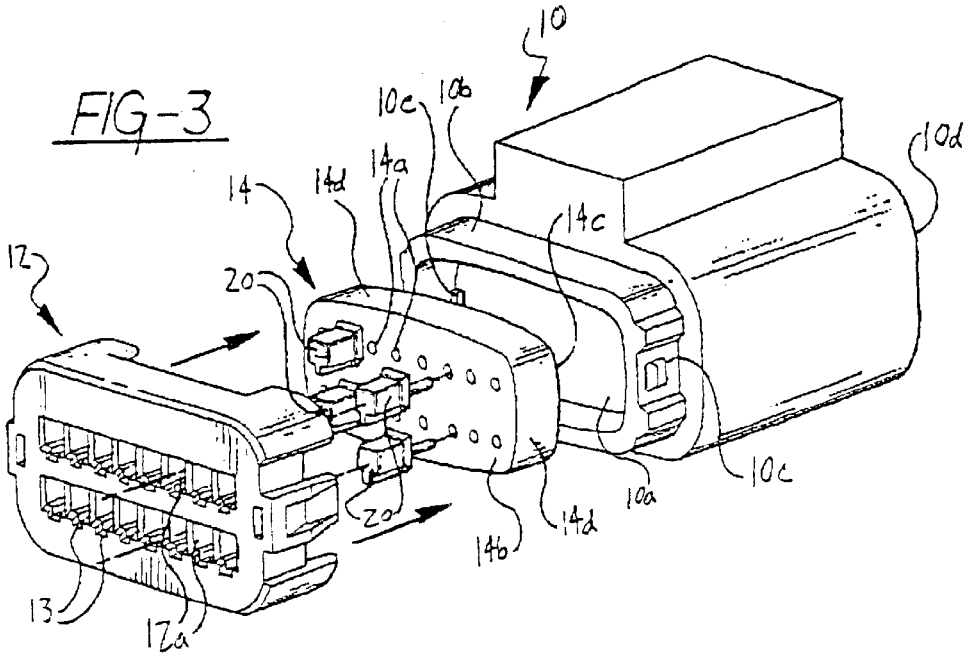
FIG. 3 is an exploded, perspective view of a sixteen-terminal connector, cover, and seal assembly incorporating a novel delete plug according to the present invention.

Referring first to FIG. 3, the invention is generally illustrated at reference numeral 20 in the form of "delete" plugs adapted to close off selected terminal openings 12*a* in cover 12, and to simultaneously seal corresponding terminal openings 14*a* in seal 14. As illustrated, plugs 20 are molded from a suitable plastic material, and it will be understood by those skilled in the art that plugs 20 can be formed from virtually any known material, although non-conductive plastics will be highly preferred. Processes other than molding can also be used to form plugs 20.

Figure 6:
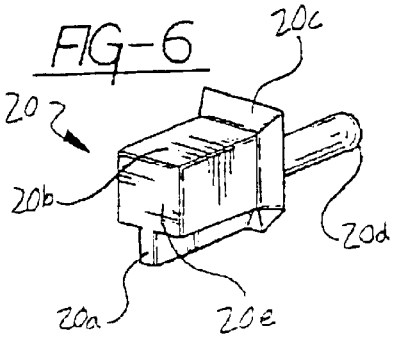
FIG. 6 is an enlarged perspective view of a delete plug according to the invention.

As best shown in FIGS. 3 and 6, plugs 20 generally comprise a main body portion 20*b* whose cross-sectional shape and length are designed to substantially fill one terminal opening 12*a* in cover 12. One side of illustrated plug 20 has a polarization or alignment portion 20*a* shaped to mate with corresponding polarization structure such as notches 13 typically found in terminal openings 12*a,* thereby preventing insertion of plug 20 into the terminal opening except in a desired orientation. Although the polarization projection 20*a* is illustrated in the form of a longitudinal rib on a lower side of plug 20, it will be apparent to those skilled in the art that virtually any shape of projection can be used, and further that it may not be a projection at all, but rather an asymmetrical body 20*b* or an indentation of some sort matching an asymmetrical terminal opening or a protruding polarization/alignment feature in the terminal opening.

Figure 5:
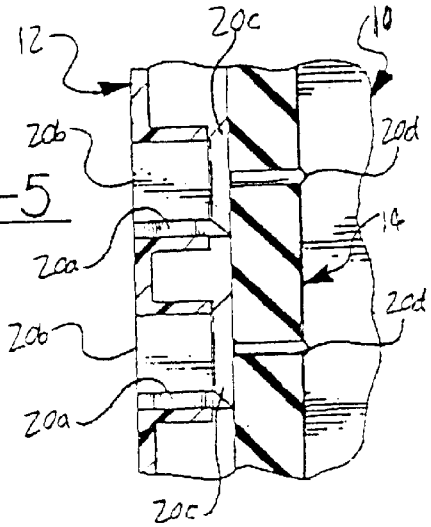
FIG. 5 is a side elevational view, partly sectioned, of the assembly of FIG. 4, and in particular of the mating, sealing relationship of the rear cover, delete plug and seal.

Plug body 20*b* is preferably sized and shaped to fit tightly in terminal opening 12*a,* as shown in FIG. 5. For this purpose, plug 20 may comprise a softer material than cover 12, and may further be slightly oversized for a secure connection.

The end of plug 20 opposite insertion end 20*b* is preferably enlarged as shown at 20*c,* in the illustrated embodiment in the form of a flared, rectangular shoulder. Shoulder 20*c* prevents plug 20 from being pushed through the terminal opening. In a most preferred form, portion 20*c* is located such that the end face 20*e* of plug 20 stops in essentially flush alignment with the outermost end of terminal opening 12*a,* as best shown in FIG. 4.

Plug 20 also includes a seal-plugging projection or finger 20*d,* located on the seal-facing end of the plug to line up with a seal opening 14*a* corresponding to the terminal opening 12*a*. Seal plugging finger 20*d* is sized for a snug, sealing fit with opening 14*a* and typically will have a diameter or width slightly larger than the diameter or width of opening 14*a*. While the shape of finger 20*d* in the illustrated embodiment is shown as a cylindrical projection, it will be understood by those skilled in the art that other cross-sectional shapes can be used, depending on the shape of the opening 14*a* in the seal 14.

In a preferred method of use, one or more delete plugs 20 is inserted into one or more corresponding terminal openings 12*a* in rear cover 12 from the inside of the cover. Plugs 20 are inserted until they are stopped by shoulder 20*c* engaging portions of the terminal openings which prevent the plug from proceeding farther. If plug bodies 20*b* and/or shoulders 20*c* are configured to be frictionally retained in terminal openings 12*a*, cover 12 can be reconfigured with plugs 20 well before the actual assembly of cover 12 to seal 14 or connector body 10. This is useful where it is desirable to reconfigure covers 12 separately from the final assembly.

Figure 4:
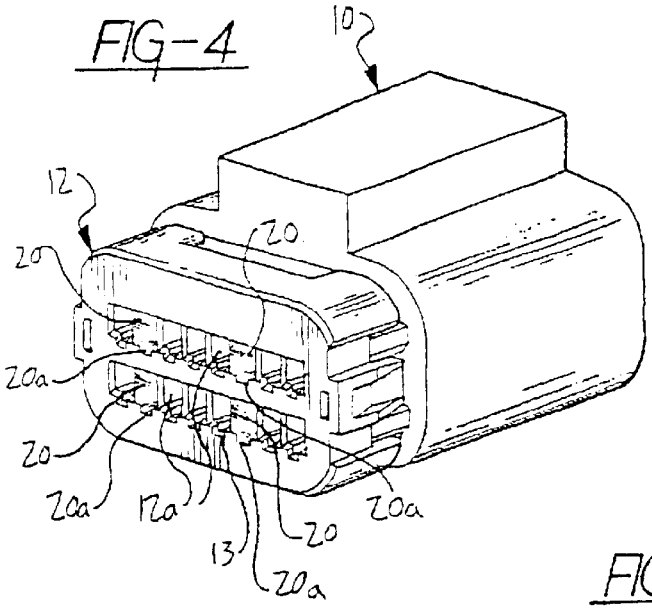
FIG. 4 illustrates the components of FIG. 3 assembled to form a female wire harness connector whose rear cover is reconfigured from an original sixteen-terminal configuration to a twelve-terminal configuration.

Once cover 12 has been reconfigured with the appropriate number of plugs 20, for example as illustrated in FIG. 4, seal 14 is applied to the plugged cover, with those holes 14*a* corresponding to plugged terminal openings 12*a* admitting seal plugging fingers 20*d*. The plugged and sealed cover can then be assembled to the connector body in known fashion, for example with lock arms 12*c* on cover 12 engaging locking platforms 10*c* on the connector body, and preferably with the side surfaces 14*d* of seal 14 inserted partway into shroud 10*b* in a frictional, sealing fit. The correct number of terminated wires is then inserted through the remaining terminal openings 12*a* and seal openings 14*a* in known fashion to engage terminal connecting and locking structure of known type inside connector body 10. Connector body 10 can then be mated with another connector to join two wire harness sections.

It will be appreciated that delete plugs 20 make it impossible to insert a terminated wire in a plugged terminal opening 12*a*. The plug-reconfigured nature of cover 12 can be made more obvious to a person putting the components of the connector assembly together by coloring at least the end faces 20*e* of plugs 20 in a hue contrasting with the color of cover 12.

The frictional fit between seal openings 14*a* and plug fingers 20*d* is preferably tight enough that seal 14 can optionally be pre-assembled to a plug-reconfigured cover 12 in advance of the final assembly of the plugged and sealed cover to connector body 10. And, while it is preferred that plugs 20 are inserted first into terminal openings 12*a* in cover 12, it will be understood that plugs 20 could be inserted first into frictional mating connection with seal openings 14*a,* as suggested by FIG. 3, as a matter of convenience.

It will be understood that the foregoing is a description of a preferred embodiment of plugs 20, and a preferred method of assembling them to cover 12 and seal 14. It will also be understood that the connector, cover and seal structure illustrated is only one of many possible, known types of sealed connector structure, and that the inventive plugs 20 can be configured to sealingly plug and mate with virtually any cover and seal combination of the type generally illustrated. The invention is not limited to a female connector, but is equally useful with sealed male connectors. Although plugs 20 are illustrated as independent pieces each capable of plugging a single terminal opening, it is within the scope of the invention to form two or more plugs 20 into a single, multi-opening plug capable of simultaneously plugging two or more terminal openings. These and other modifications of the structure illustrated will be apparent to those skilled in the art, and are intended to be included within the scope of the present invention as defined in the following claims.

Accordingly, I claim:

1. In combination with a wire harness connector body of the type having a seal and cover for receiving a plurality of terminated wires, the cover having an inner end, an outer end and a plurality of terminal openings extending through the cover from the outer end to the inner end and adapted to have terminated wires inserted therethrough from the outer end, through the inner end and into the seal, the seal having terminal openings adapted to receive the terminated wires therethrough, an apparatus for reconfiguring the seal and cover, comprising:

a delete plug having a body with a first end shaped to be inserted into a terminal opening in the cover from the inner end of the cover and a second end with a shoulder sized to prevent the plug body from being pushed out of the terminal opening of the cover from the inner end of the cover and out of the outer end of the cover; and a seal-plugging member extending from the second end of the body and adapted to be inserted into a corresponding terminal opening in the seal.

2. The apparatus of claim 1, wherein the plug body is configured to be positively retained in the terminal opening.

3. The apparatus of claim 2, wherein the plug body is configured to be removably positively retained in the terminal opening.

4. The apparatus of claim 1 wherein the plug body and the shoulder are configured and located to positively retain an end face at the first end of the plug body in an essentially flush relationship with an outside face of the cover at the terminal opening.

5. The apparatus of claim 1, wherein the terminal openings in the cover include an alignment feature, and the plug body includes a mating alignment feature such that the plug body can be inserted in the terminal opening only when the alignment feature in the terminal opening and the mating alignment feature on the plug body are aligned.

6. The apparatus of claim 1, wherein the seal-plugging member is sized to engage the terminal opening in the seal in a sealing fit.

7. The apparatus of claim 6, wherein the fit between the seal-plugging member and the terminal opening seal is sufficiently tight to frictionally connect the seal-plugging member to the seal.

8. The apparatus of claim 1 wherein the delete plug body has a cross-sectional shape and length sufficient to substantially fill the cover terminal opening in which it is inserted.

9. The apparatus of claim 1 wherein:

the delete plug having a first color; and the cover having a second color, the first color being different than the second color.

10. In combination with a seal and cover assembly fastened to a wire harness connector body with the seal sandwiched between the cover and the wire harness connector body, an inner end of the cover adjacent an outer end of the seal, the cover having a plurality of terminal openings therethrough and the seal having a plurality of corresponding terminal openings, an apparatus for reconfiguring the seal and cover assembly with respect to the available terminal openings capable of receiving terminated wires, comprising:

one or more delete plugs mounted between the cover and the seal, each delete plug having a body removable and returnably inserted into one of the plurality of delete plug having a body removable and returnably inserted into one of the plurality of terminal openings in the cover from the inner end of the cover and a seal-plugging member inserted into one of the corresponding terminal openings in the seal from the outer end of the seal, wherein each delete plug body has a polarizing projection extending along one side of the body, the polarization projection received in a polarization notch in the terminal opening of the cover.

11. The apparatus of claim 10 wherein the delete plug body has a cross-sectional shape and length to substantially fill the cover terminal opening in which it is inserted.

12. The apparatus of claim 10 wherein the delete plug body has a first end inserted into the terminal opening in the cover from the cover inner end, and a second end interfering with the inner end of the terminal opening to prevent the delete plug from being pushed fully through the terminal opening from the inner end.

13. In an assembly comprising a wire harness connector body of the type having a seal and cover for receiving a plurality of terminated wires with the seal sandwiched between the cover and the wire harness connector body, an inner end of the cover adjacent an outer end of the seal, the cover having a plurality of terminal openings therethrough and the seal having a plurality of corresponding terminal openings therethrough, a method for reconfiguring the seal and cover, the method comprising the following steps:

inserting a delete plug into a terminal opening in the cover from the inner end of the cover and further inserting a seal-plugging member of the delete plug into a corresponding terminal opening in the seal, thereby rendering the terminal opening in the cover and the corresponding terminal opening in the seal closed to the insertion of a terminated wire.

* * * * *